US006040809A

United States Patent [19]

Friedman

[11] Patent Number: 6,040,809

[45] Date of Patent: Mar. 21, 2000

[54] FED DISPLAY ROW DRIVER WITH CHIP-TO-CHIP SETTLING TIME MATCHING AND PHASE DETECTION CIRCUITS USED TO PREVENT UNEVEN OR NONUNIFORM BRIGHTNESS IN DISPLAY

[75] Inventor: Jay Friedman, Felton, Calif.

[73] Assignee: Candescent Technologies Corporation, San Jose, Calif.

[21] Appl. No.: 09/016,829

[22] Filed: Jan. 30, 1998

[51] Int. Cl.[7] ..... G09G 3/32; G09G 5/00

[52] U.S. Cl. ..... 345/74; 345/204

[58] Field of Search ..... 345/74, 75, 77, 345/204, 205; 313/422, 336; 348/796, 531, 540

[56] References Cited

U.S. PATENT DOCUMENTS

| | | | |
|---|---|---|---|
| 5,294,919 | 3/1994 | Harju | 345/79 |
| 5,488,386 | 1/1996 | Yamagishi et al. | 345/74 |
| 5,541,473 | 7/1996 | Duboc, Jr. et al. | 313/422 |
| 5,559,389 | 9/1996 | Spindt et al. | 313/310 |
| 5,564,959 | 10/1996 | Spindt et al. | 445/24 |
| 5,578,899 | 11/1996 | Haven et al. | 313/422 |
| 5,610,667 | 3/1997 | Hush | 345/74 |
| 5,638,085 | 6/1997 | Hush et al. | 345/74 |
| 5,847,515 | 12/1998 | Lee et al. | 345/74 |
| 5,854,615 | 12/1998 | Hush | 345/99 |

*Primary Examiner*—Jeffery Brier
*Assistant Examiner*—Paul A. Bell
*Attorney, Agent, or Firm*—Wagner, Murabito & Hao LLP

[57] ABSTRACT

A device for and method of eliminating objectionable bands of uneven brightness in flat panel field emission displays (FEDs). Within the FED screen, a matrix of rows and columns is provided and emitters are situated within each row-column intersection. Rows are activated sequentially by row drivers and discrepancies in row driver settling times among the row drivers cause bands of uneven brightness on the display screen. The present invention normalizes row settling time of row driver integrated circuits that can be variant due to differences in semiconductor processing and manufacturing. The present invention includes specialized circuitry coupled to the row drivers for sensing an output of the row driver and determining a difference between the output and a threshold at a particular time before the output has completely settled to a target voltage. In response to the difference, gate voltages of output transistors within the row driver are altered in order to adjust the settling time of the row driver to match a target settling time. As a result, the settling times of all the row drivers in the FED screen are matched. Consequently, the brightness variation problem is eliminated.

23 Claims, 7 Drawing Sheets

320

FED DISPLAY ROW DRIVER WITH CHIP-TO-CHIP SETTLING TIME MATCHING AND PHASE DETECTION CIRCUITS USED TO PREVENT UNEVEN OR NONUNIFORM BRIGHTNESS IN DISPLAY

FIELD OF THE INVENTION

The present invention relates to the field of flat panel display screens. More specifically, the present invention relates to the field of flat panel field emission displays (FEDs).

BACKGROUND OF THE INVENTION

Flat panel field emission displays (FEDs), like standard cathode ray tube (CRT) television sets, generate light by impinging high energy electrons on a picture element of a phosphor screen. The excited phosphor then converts the electron energy into visible light. However, unlike conventional television CRTs which use a single electron beam to scan across the phosphor screen in a raster pattern, FEDs use individual stationary electron sources for each pixel of the phosphor screen. Thus, a screen with a million color pixels has at least a million individual electron sources. There are three electron sources, each source consisting of many emitters, for each pixel in RGB color screen; one for red, one for green and one for blue. By using stationary electron sources instead of a scanning beam, the distance between the electron source and the phosphor screen can be made to be extremely small. Consequently, FED displays can be made to be very thin.

As mentioned, conventional CRT displays use electron beams to scan across the phosphor screen in a raster pattern. Specifically, the electron beams scan along a row in a horizontal direction and adjust the intensity according to the desired brightness of each picture element of that row. The electron beams then step in a column (vertical) direction and scan the next row until all the rows of the display screen are scanned. In marked contrast, in FEDs, a group of stationary electron sources are formed for each picture element (pixel) of the display screen. More specifically, the pixels of an FED flat panel screen are arranged in an array of horizontally aligned rows and vertically aligned columns. A portion 100 of this array is shown in FIG. 1. The boundaries of a respective pixel 125 are indicated by dashed lines and in this configuration include a red point, a green point, and a blue point. Three separate row lines 130*a*–130*c* are shown. Each of the row lines 130*a*, 130*b*, and 130*c* is a row electrode for one of the rows of pixels in the array. A pixel row is comprised of all the pixels along one row line 130. Each column of pixels may include three columns lines 150: one for red, a second for green, and a third for blue. The column lines 150 control gate electrodes of the FED screen. When electron-emitting elements contained within the row electrode are suitably excited by adjusting the voltage of the corresponding row lines 130 (row cathodes) and column lines 150 (gate electrodes), electrons are emitted and are accelerated toward a phosphor anode 120. The excited phosphors at the anode 120 then emit light.

The row lines 130 are driven by a plurality of row drivers in the display. Each row driver is responsible for driving a group of rows. However, only one row is active at a time across the entire FED flat panel display screen. Therefore, an individual row driver drives at most one row electrode at a time. A supply voltage line is coupled to all row drivers and supplies the row drivers with a driving voltage for application to the row cathodes. During a screen frame refresh cycle (performed at a rate of approximately 60 Hz), one row is energized to illuminate one row of pixels for an "on-time" period. This is typically performed sequentially in time, row by row, until all pixel rows have been illuminated to display the frame. Assuming frames are presented at 60 Hz and the FED display has n rows in the display array, each row is energized at a rate of 16.7/n ms. In a typical display having 480 rows, each row is energized at a rate of 34.8 $\mu$s. The brightness of the target phosphor at the anode 120 depends on the amount of time a voltage is applied across the row electrode and the gate (e.g., on-time window). The larger the on-time window, the brighter the pixel will appear to a viewer. Since the rows are energized at a high rate, it is critical to ascertain that each row is energized at exactly the same time after the rows are activated. Otherwise, if some rows have a slightly longer "on-time" than the others, the brightness across the screen will not be uniform which can cause unwanted screen artifacts.

Unfortunately, in prior art FED systems, it is difficult to ascertain a uniform "on-time" for all the row drivers. The principal reason is attributed to manufacturing complications which cause row drivers to have different settling times. That is, row drivers which settle faster than others activate or deactivate the rows quicker, causing slight discrepancies in the "on-time" among the rows. FIG. 1B illustrates this problem. As shown, the row driver 1 settles at a faster rate than row driver 2, but slower than row driver 3, causing differences in the "on-time" windows among the rows. As a result, bands of uneven brightness appear on the display. A means to cause the row drivers to settle to the same voltage at the same time eliminates this brightness variation problem. One prior art method of matching the settling times of the row drivers fabricates the row drivers from adjacent dice on the same wafer. This solution, however, is not practical because there is no guarantee that row drivers made from the same wafer have the same settling time. Further, if one row driver in a display malfunctions, the whole set of row drivers have to be replaced with others from the same wafer.

Accordingly, the present invention provides a mechanism and device for eliminating objectionable horizontal bands of different brightness on the display. The present invention also provides a mechanism and device for normalizing the settling times of all the row drivers in a FED display. These and other advantages of the present invention not specifically mentioned above will become clear within discussions of the present invention presented herein.

SUMMARY OF THE INVENTION

A circuit and method are described herein for providing uniform display brightness by eliminating objectionable bands of uneven brightness in flat panel field emission display (FED) screen. Within the flat panel FED screen, a matrix of rows and columns is provided and electron emitters are situated within each row-column intersection. In one embodiment, rows are activated sequentially from the top most row down to the bottom row with only one row asserted at a time; and only one row driver is active at a time. When a proper voltage is applied across the cathode and gate of the emitters, they release electrons toward a respective phosphor spot, causing an illumination point on the display.

According to one embodiment of the present invention, each row line of the FED screen is activated and deactivated when driven to a row "ON" voltage ($V_{ON}$) and a row "OFF" voltage or ground (GND), respectively, by a row driver. By measuring an output voltage of the row driver, the settling speed of the row driver is then determined, and a signal representative of the settling speed is generated. The signal is then used to adjust the settling speed of the row driver by altering gate voltages of transistors in the output stages of the row drivers. As a result, the settling times of all the row drivers in the FED screen are matched. Consequently, the brightness variation problem is eliminated.

In one embodiment, the FED screen according to the present invention includes a plurality of column drivers each having a first output stage for forming an output voltage for one column, and a second output stage for forming a dummy output voltage periodically. The FED screen also includes a plurality of phase-detectors each coupled to the row drivers for receiving the dummy output voltage and for determining a phase delay of the output voltage. A gate voltage of transistors in the first output stage is adjusted according to the phase delay such that the settling process is accelerated or decelerated. Preferably, outputs of the phase detectors are coupled to filter/buffer circuits for temporarily storing the phase detector output and for providing appropriate current to bias the output stages. Further, dummy outputs of the column drivers are preferably coupled together to drive a dummy load, and each column driver is preferably configured to generate the dummy output voltage sequentially.

Specifically, embodiments of the present invention may include a field emission display screen comprising: a plurality of rows and columns; a plurality of column drivers coupled to the columns, a plurality of row drivers each having a plurality of row driver outputs, wherein each row driver output is coupled to one row line, further wherein each row driver includes a dummy output for generating a dummy voltage periodically; a plurality of phase detectors for detecting a phase difference between a dummy voltage settling time of each row driver and a target settling time, and for producing a voltage signal representative of the phase difference; and, a loop filter/buffer circuit for averaging the voltage signal over time to form a gate-biasing voltage; wherein the gate-biasing voltage biases transistors of output stages of the row drivers such that the settling times of the column drivers are normalized.

DETAILED DESCRIPTION OF THE PREFERRED EMBODIMENT

In the following detailed description of the present invention, a method and mechanism to provide uniform display brightness by eliminating objectionable bands of uneven brightness on an FED screen, numerous specific details are set forth in order to provide a thorough understanding of the present invention. However, it will be recognized by one skilled in the art that the present invention may be practiced without these specific details or with equivalents thereof. In other instances, well known methods, procedures, components, and circuits have not been described in detail as not to unnecessarily obscure aspects of the present invention.

In the following, the present invention is discussed in relation to flat panel field emission display (FED) systems. FED is an emerging technology, and specific embodiments of this technology are described in U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are incorporated herein by reference. However, it should be apparent to those skilled in the art, upon reading this disclosure, that the present invention and principles described herein may be applied to other types of display systems as well.

Figure 1A:
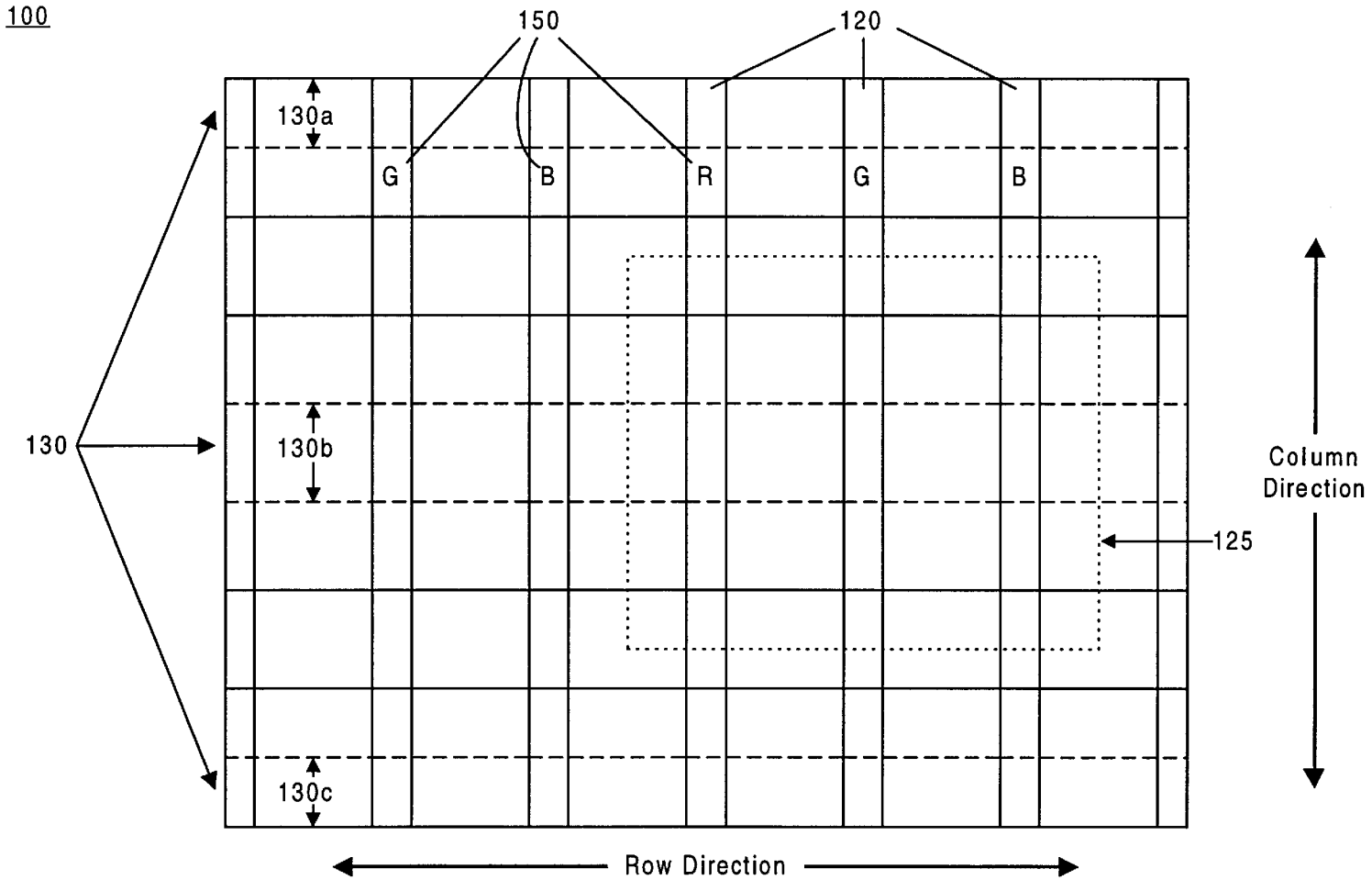
FIG. 1A (Prior Art)
FIG. 1A is a plan view of internal portions of a flat panel FED and illustrates several intersecting rows and columns of the display.
Figure 1B:
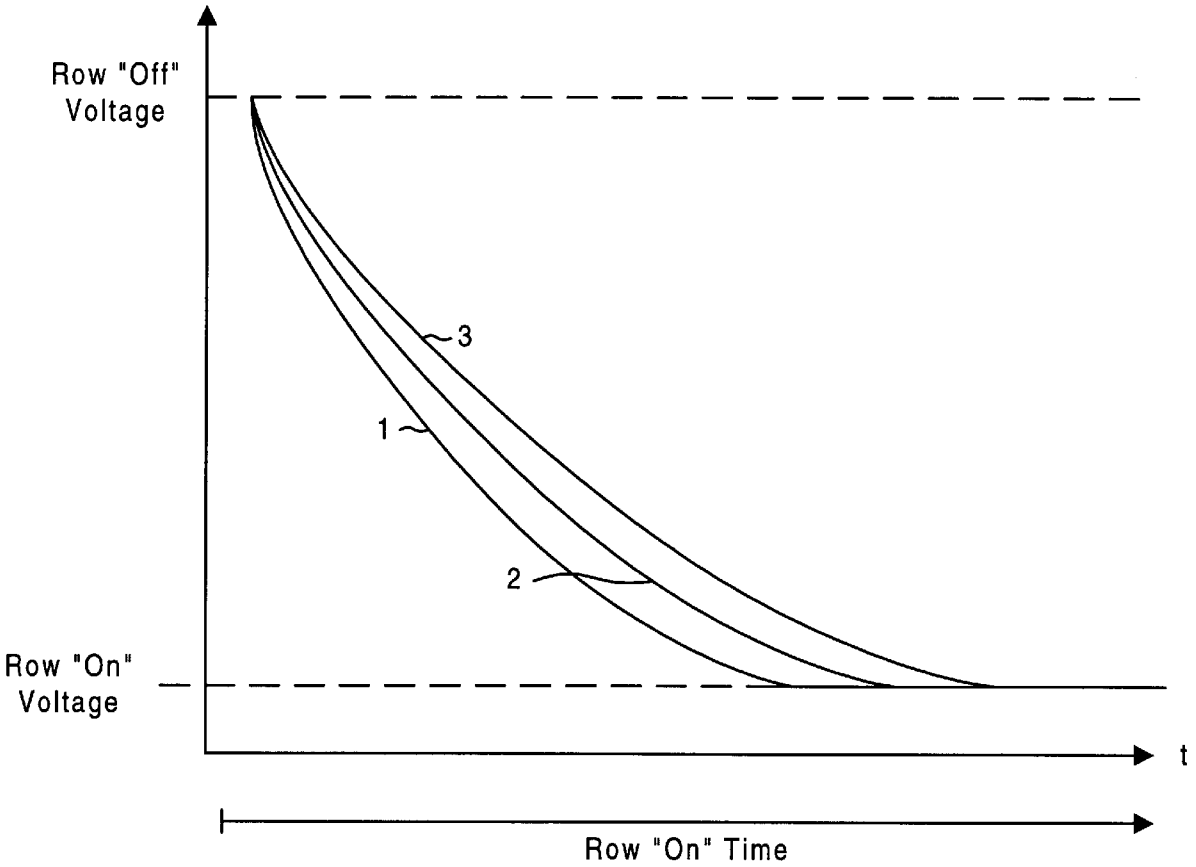
FIG. 1B (Prior Art)
FIG. 1B is a graph showing the output voltages of three separate prior art row drivers as a function of time.
Figure 2A:
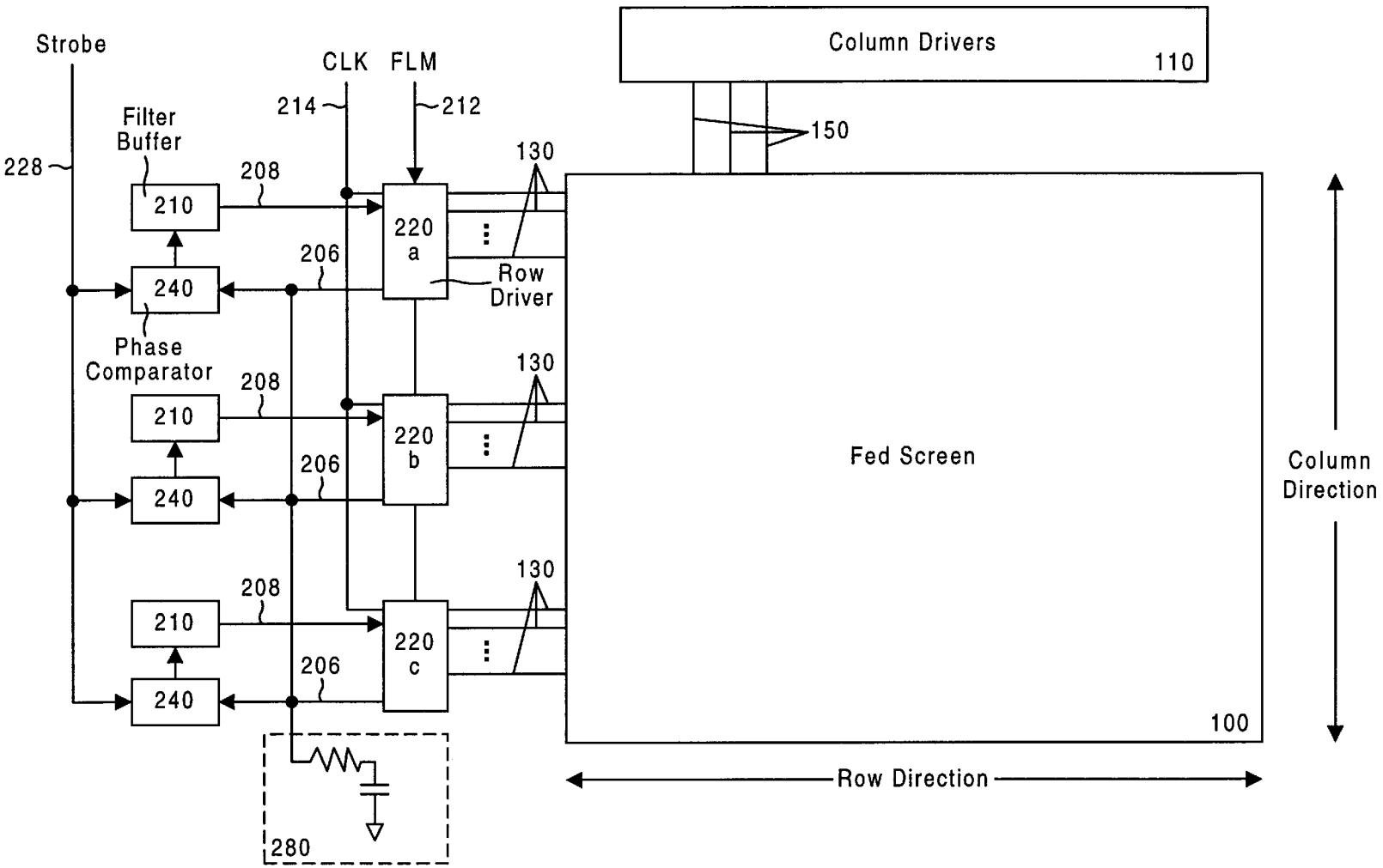
FIG. 2A illustrates a block diagram of the present invention including a flat panel FED screen, a plurality of row drivers and phase detectors.

FIG. 2A illustrates a block diagram of an FED system 200 in accordance with the present invention. As shown, the FED system 200 includes an FED screen 100 as shown in FIG. 1, column drivers 110 for driving the column lines 150, row drivers 220 for driving the row lines 130, and phase detection circuits 240 for determining a settling time of the row drivers 220. For clarity, only three row drivers 220*a*, 220*b*, and 220*c* are shown. However, it should be apparent to those of ordinary skill in the art, upon reading the present disclosure, that the number of row lines driven by each row driver 220 is arbitrary and that any number of row drivers 220 may be coupled together to drive an unlimited number of row lines 130.

In the preferred embodiment, the FED system 200 is operating in a sequential frame update mode. That is, each row is sequentially activated and deactivated. In order to drive the rows sequentially, row drivers 220 are configured to emulate a large serial shift register having n bits of storage, one bit per row. Row data (FLM) is supplied to the row drivers 220 via data line 212 and is shifted through these row drivers 220*a–c* in a serial fashion. During frame update, all but one of the bits of the n bits within the row drivers contain a "0" and the other one contains a "1". Therefore, the "1" is shifted serially through all n rows, one at a time, from the upper most row to the bottom most row. The bit is shifted through the row drivers 220*a–c* one step every pulse of a clock CLK as provided by line 214. In other embodiments, the present invention may operate in an interlace mode where the odd rows are updated in series followed by the even rows. In the interlace mode or other operation modes, a different bit pattern and clock scheme is used.

In the preferred embodiment, the row driver 220 containing the "1" is activated for a row driver active period. For instance, the row driver 220*a* is active when it contains the "1," and will remain active until the "1" is shifted out of the row driver 220*a*. In the following discussion, it is assumed that, unless noted otherwise, the row driver 220*a* is active. During this row driver active period, the active row driver 220*a* provides a dummy voltage ($V_{DUMMY}$) via a dummy output line 206. The exact time when the dummy voltage is provided during the row driver active period is arbitrary. For instance, the row driver 220 may provide the dummy voltage while driving the third row line 130. In the preferred embodiment, the row drivers 220 are activated one at a time, and $V_{DUMMY}$ is produced once per row driver active period. Thus, even though the dummy output line 206 is coupled to the row drivers 220*a–c*, only $V_{DUMMY}$ from the active row driver 220 will appear on the dummy output line 206 at any one time.

Figure 2B:
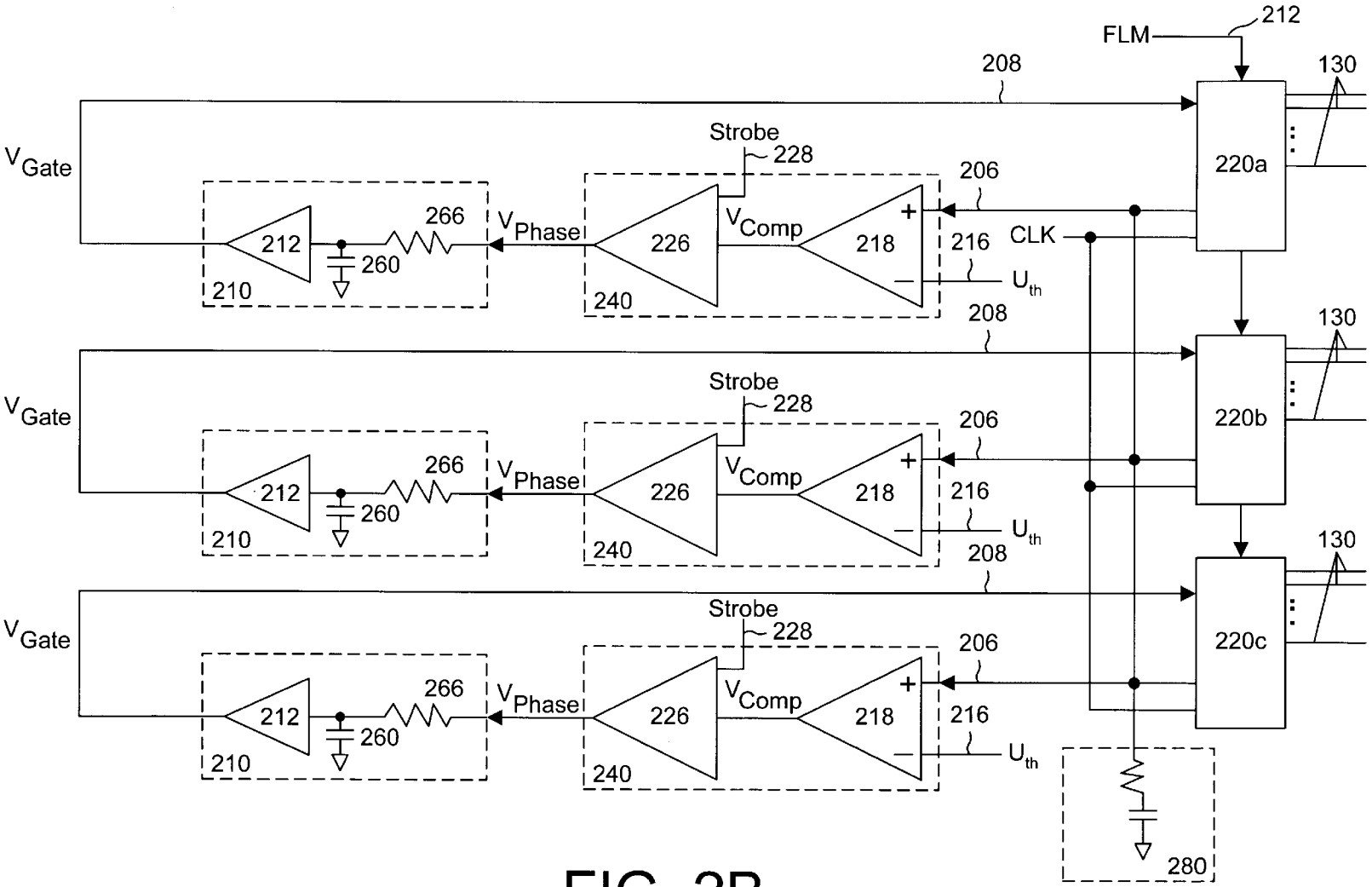
FIG. 2B illustrates a schematic of the phase detectors coupled to row drivers of the present invention.

The dummy output line 206 is coupled to provide $V_{DUMMY}$ to the phase detection circuit 240. The phase detection circuit 240 measures a time difference between the time $V_{DUMMY}$ reaches a threshold voltage and a target settling time. Depending on the time difference, the phase detection circuit 240 produces a phase signal $V_{PHASE}$, which is then filtered and buffered by filter/buffer circuit 210 to produce a gate-biasing voltage $V_{GATE}$. In FIGS. 2A and 2B, the phase detection circuit 240 is shown to be external to the row drivers 220. However, it should be apparent to a person of ordinary skill in the art, upon reading this disclosure, that the phase detection circuit 240 may be integrated with row driver circuits on the same chip.

Each row driver 220 also comprises a gate-voltage line 208. The gate-voltage input 208 is coupled to receive the gate-biasing voltage $V_{GATE}$ from the phase detection circuit 240. The gate-biasing voltage $V_{GATE}$, which is supplied by the filter/buffer circuit 210, biases a gate voltage of output transistors in the active row driver 220*a*, and thereby increases or decreases the rate the active row driver 220*a* reach a target voltage. The gate-biasing mechanism will become more apparent as the operations of the present invention are presented in greater detail below. In one embodiment, the target voltage is a driving voltage supplied to the row drivers 220. The driving voltage is preferably the row "ON" voltage $V_{ON}$, which is typically −20 V for FEDs. Naturally, other voltages may also be applied when the row drivers 220 are used for different types of displays.

Figure 4A:
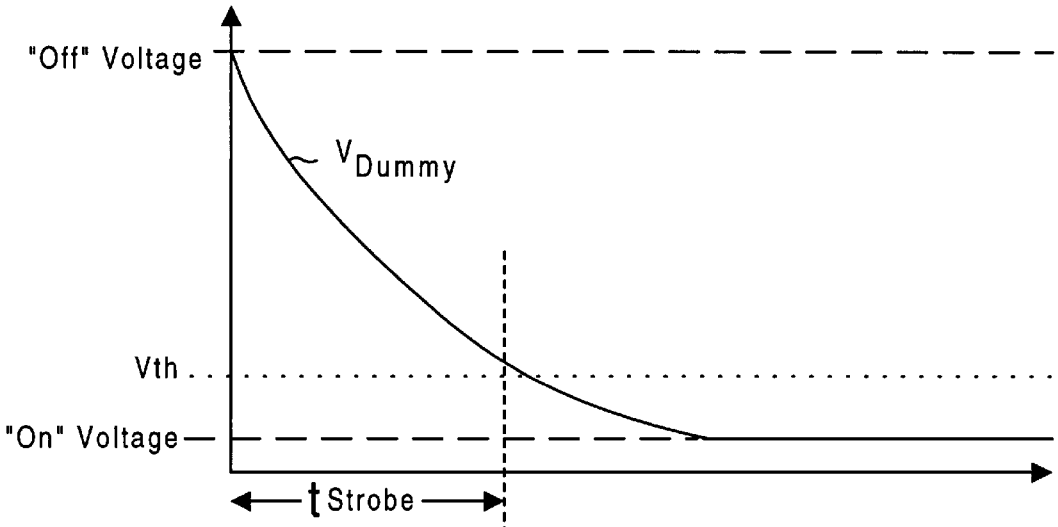
FIGS. 4A, 4B, 4C, 4D, 4E, and 4F illustrate timing diagrams for signals $V_{DUMMY}$, CLK, STROBE, $V_{COMP}$, a positive $V_{PHASE}$ pulse, and a negative $V_{PHASE}$ pulse for a row driver of the present invention.

FIG. 2B illustrates a schematic of the phase detection circuit 240 and the filter/buffer circuit 210. In the preferred embodiment, the phase detection circuit 240 comprises a comparator 218 and a phase detector 226. A positive input of the comparator 218 is coupled to the dummy output line 206 to receive $V_{DUMMY}$, and a negative input is coupled to a line 216 for receiving a threshold voltage $V_{TH}$. The comparator 218 compares $V_{DUMMY}$ to $V_{TH}$, and produces an output voltage $V_{COMP}$. In the preferred embodiment, the row "ON" voltage is −20.0 V, and $V_{TH}$ is set at −19.8 V. Thus, as illustrated in FIGS. 4A and 4D, when $V_{DUMMY}$ changes from $V_{OFF}$ to $V_{ON}$, the output $V_{COMP}$ of the comparator 218 changes sharply from a logic high voltage to a logic low voltage when $V_{DUMMY}$ across $V_{TH}$. As a result, a sharp falling edge 504 (FIG. 4D) is generated.

The output of the comparator 218 is coupled to provide $V_{COMP}$ to a first input of a phase detector 226. A second input of the phase detector 226 is coupled to receive a STROBE signal from line 228. The phase detector 226 is sensitive to the relative timing of edges between the two input signals. Upon encountering a rising edge 506 of a STROBE pulse 503 (FIG. 4C) before the falling edge 504 of $V_{COMP}$ (phase lag), the phase detector 226 will be activated to produce a pulse 505 having a positive polarity (FIG. 4E). However, if the phase detector 226 detects a phase lead, a pulse 506 having a negative polarity will be produced (FIG. 4F). Thus, depending on whether the transition of the $V_{COMP}$ occurs before or after the transition of the reference signal STROBE, the phase comparator 226 generates either lead or lag output pulses, respectively. The polarity and width of these $V_{PHASE}$ pulses is representative of the phase difference between the respective edges. The output circuitry (not shown) of the phase detector 226 either sinks or sources current (respectively) during those $V_{PHASE}$ pulses and is otherwise open-circuited, generating an average output voltage over multiple cycles. In one embodiment, the phase detector 226 is a common CMOS digital integrated circuit 4046 available from many IC manufacturers.

Preferably, the dummy output line 206 is coupled to all the row drivers 220 . As the row drivers 220 are activated one at a time, only the dummy output voltage from the active one of the row drivers 220 will be present on the dummy output line 206. Further, in the preferred embodiment, the dummy output line 206 is coupled to a dummy load 280. The dummy load 280 is configured to have resistance and capacitance similar to a row in the FED screen 100 . In this way, the dummy output voltage $V_{DUMMY}$ will more closely track the output voltage $V_{OUT}$ at the row lines 130. In an alternate embodiment, the dummy output line 206 may be coupled to drive one of the rows of the FED screen 100 instead of a dummy load.

In operation, during each frame update, an active one of the row drivers 220 generates dummy output voltage $V_{DUMMY}$, which is compared to threshold voltage $V_{TH}$ by the comparator 218 to produce comparator output voltage $V_{COMP}$. As $V_{DUMMY}$ changes from $V_{OFF}$ to $V_{ON}$ across $V_{TH}$, falling edge 504 in $V_{COMP}$ will be generated. The comparator output $V_{COMP}$ is coupled to phase detector 226, which detects whether the falling edge 504 occurs before or after rising edge 506 of STROBE pulse 503. For instance, if the falling edge 504 lags behind the rising edge 506, $V_{PHASE}$ pulse 505 having a positive polarity will be generated. If the falling edge 504 leads the rising edge 506, $V_{PHASE}$ pulse 507 having a negative polarity will be generated. The $V_{PHASE}$ pulses are filtered and buffered to produce a voltage $V_{GATE}$ representative of the phase lead or lag over a number of preceding frames. The voltage $V_{GATE}$ is fed back to the row drivers 220 and biases gate voltages of output transistors of the active row driver 220*a*. As the gate-biasing voltage $V_{GATE}$ is dynamically adjusted to cause $V_{DUMMY}$ to cross $V_{TH}$ at the target settling time, the settling times of the row drivers 220 will be normalized. Thus, objectionable bands of uneven brightness of the FED display will be eliminated.

FIG. 2B also illustrates a loop filter/buffer circuit 210 including a resistor 266 coupled to a capacitor 260 and to an input of a buffer 212. The loop-filter/buffer 210 integrates the output pulses of the phase detector 226, and produces the gate-biasing voltage $V_{GATE}$ which provides appropriate current for biasing output transistors of the row drivers 220 so that the desired settling time occurs. The output of the filter/buffer circuit 210, $V_{GATE}$, varies according to the polarity and pulse-width of the output pulses $V_{PHASE}$. For instance, if the row driver 220 is slow and lags behind STROBE by a large margin, the width of the output pulses $V_{PHASE}$ will be large, the resulting $V_{GATE}$ will be more positive. In the preferred embodiment, the output transistors of the row drivers 220 are configured to settle at a faster rate in respond to a more positive gate voltage $V_{GATE}$. Consequently, settling process at the row drivers 220 is accelerated.

Figure 4B:
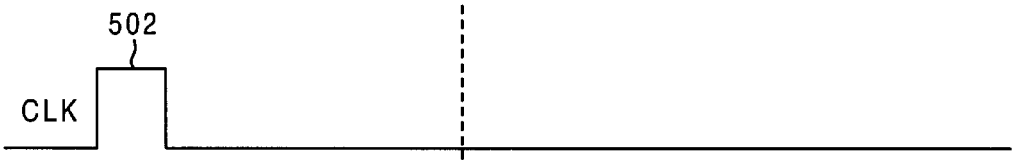
Figure 4C:
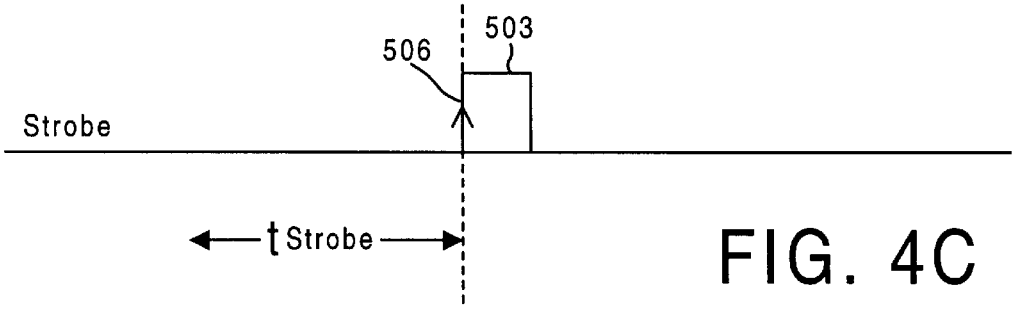
Figure 4D:
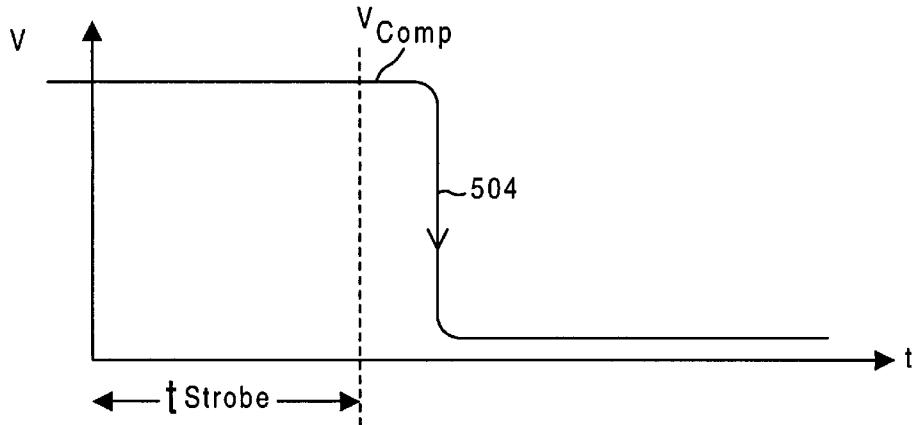
Figure 4E:
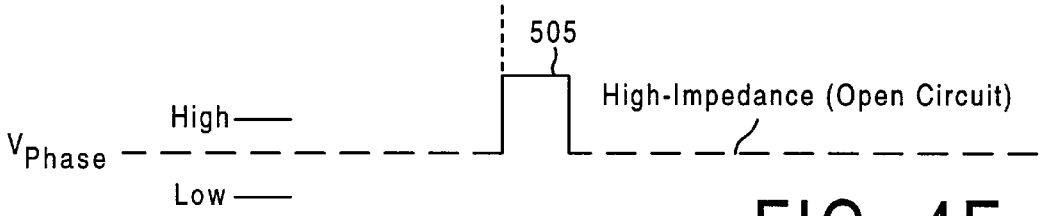
Figure 4F:
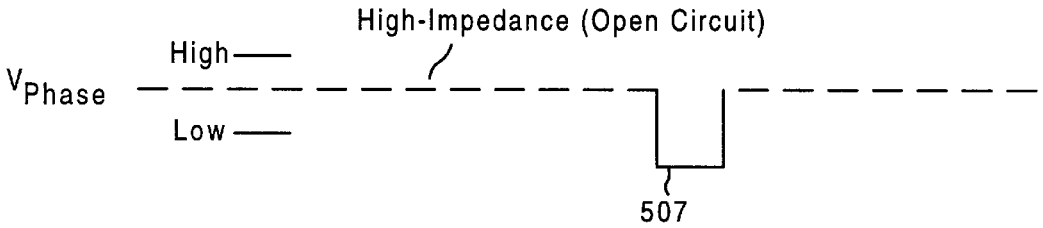

FIGS. 4A–F illustrate timing diagrams and phase diagrams of the operations of the active row driver 220*a* in accordance with the present invention. FIG. 4A illustrates a dummy output voltage $V_{DUMMY}$ produced by an active row driver 220 . As shown, as $V_{DUMMY}$ drops from $V_{OFF}$ to $V_{ON}$, it crosses $V_{TH}$. However, $V_{DUMMY}$ does not cross $V_{TH}$ at a target settling time $\tau_{STSOBE}$. FIG. 4B illustrates a pulse of the clock signal CLK. In FIG. 4B, only one clock pulse 502 is shown for clarity. Upon receiving the pulse 502, the active row driver 220 produces the dummy voltage $V_{DUMMY}$ at the dummy output line 206 (FIG. 2*b*). FIG. 4D illustrates the output $V_{COMP}$ of comparator 218. As shown, a sharp falling edge 504 occurs when $V_{DUMMY}$ drops from $V_{OFF}$ to $V_{ON}$ across $V_{TH}$. The comparator output voltage $V_{COMP}$ is compared to STROBE by phase detector 226.

FIG. 4C illustrates a pulse 503 of the strobing signal STROBE at target settling time $\tau_{STSOBE}$. Preferably, STROBE is generated by logic control circuitry (not shown) external to the row drivers 220 . STROBE, like CLK, is a cyclical signal. However, unlike CLK, STROBE occurs once per row driver per frame update. Only one pulse 503 of the strobing signal STROBE is shown in FIG. 4C for clarity.

According to the preferred embodiment, the phase detector 226 is edge-triggered to generate $V_{PHASE}$ pulses. Essentially, the polarity and width of the $V_{PHASE}$ pulse 505 is determined by how early or late $V_{DUMMY}$ reaches $V_{TH}$ with respect to STROBE. As shown in FIG. 4E, the output of the phase detector 226, which is in a high-impedance state before the rising edge 503, is pulled up to a logic high voltage upon detecting the rising edge 503. The output of the phase detector 226 remains in a logic high voltage until encountering the falling edge 504. The output of the phase detector 226 is deactivated by the falling edge 504, and the output returns to a high-impedance state. FIG. 4F illustrates a negative $V_{PHASE}$ pulse, which is generated when the $V_{DUMMY}$ cross $V_{TH}$ before the rising edge 506 of STROBE.

Figure 3:
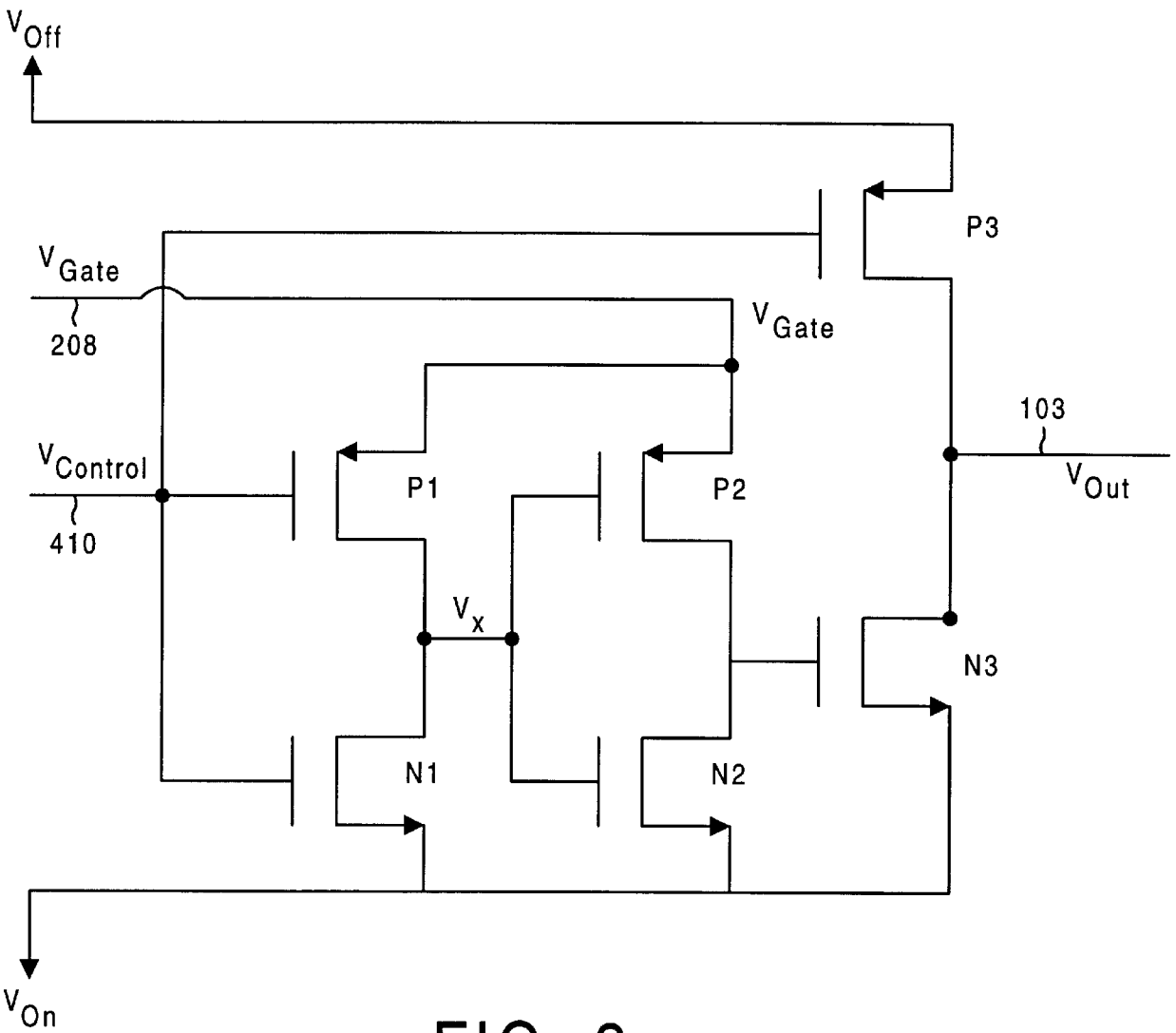
FIG. 3 illustrates a transistor level schematic of an output stage of a row driver according to the present invention.

A discussion of how the gate-biasing voltage $V_{GATE}$ biases the output transistors of the row drivers 220 follows. FIG. 3 illustrates a transistor level schematic of an output stage 320 of a row driver 220 according to the present invention. As shown, the output stage 320 comprises PMOS P1, P2 and P3, and NMOS N1, N2, and N3. Preferably, the P1, P2 and P3 are enhancement type p-channel MOSFETs, and N1, N2, and N3 are enhancement type n-channel MOSFETs. Preferably, transistor P3 has a source coupled to $V_{ON}$ and a gate coupled to line 410 for receiving a control signal $V_{CONTROL}$. A drain of the transistor P1 coupled a drain of the transistor N3 to form an output voltage $V_{OUT}$ at the row line 130. A source of the transistor N3 is coupled to a voltage supply line for receiving $V_{OFF}$, and a gate of the transistor N3 is coupled to a drain of the N2. The source of the transistor N2 is coupled to $V_{OFF}$, and the gate of the transistor N2 is coupled to a gate of the transistor P2. The gate of N2 is also coupled to a drain of transistor P1 and a drain of the transistor N1. A source of the transistor P2 is coupled to a source of the transistor P1, and is coupled the gate voltage line 208 to receive $V_{GATE}$. A gate of the transistor P1 is coupled to a gate of the transistor N1, and is coupled to receive $V_{CONTROL}$. A source of the transistor N1 is coupled to $V_{OFF}$.

When $V_{CONTROL}$ is at $V_{ON}$, transistor N1 is cut off. Transistor P1, however, is conducting, and drives a voltage Vx at the drains of P1 and N1 to $V_{GATE}$. When Vx is driven to $V_{GATE}$, transistor P2 is cut off, and transistor N2 is conducting, driving a gate voltage at N3 to $V_{ON}$ to cut off transistor N3. At the same time, transistor P3 is conducting. Thus, $V_{OUT}$ is driven to $V_{OFF}$ when $V_{CONTROL}$ is at $V_{ON}$. In this embodiment, the rows of the FED screen are turned off when $V_{OUT}$ is at $V_{OFF}$.

When $V_{CONTROL}$ is at $V_{ON}$, transistor P1 is cut off. Drain current of P1 is limited to a very small leakage current. Transistor N1, on the other hand, is conducting, driving the voltage Vx at the drains of P1 and N1 to $V_{ON}$. When Vx is driven to $V_{ON}$, N2 is cut off and P2 is conducting. Since a source voltage of transistor P2 is $V_{GATE}$, a gate voltage of N3 will be driven to $V_{GATE}$. At the same time, P3 is cut off, and N3 is conducting. Thus, $V_{OUT}$ will be driven to $V_{ON}$. Further, the rate of change of $V_{OUT}$ will be dependent upon a value of the voltage $V_{GATE}$. For instance, if $V_{GATE}$ is more positive, transistor N3 will be driven to $V_{ON}$ at a higher rate, since the row is capacitive. However, if the gate voltage $V_{GATE}$ is less positive, less gate current will flow, and N3 will be driven to $V_{ON}$ at a slower rate. Thus, $V_{GATE}$, which varies according to the settling time of the active one of the row drivers 220 , controls the rate of change of the output, and alters the settling time of the active row driver 220 accordingly.

The operation of the output stage 320 is summarized by Table 1. Transistors that are cut off are designated as "OFF," and transistors that are conducting are designated as "ON."

TABLE 1

| | $V_{CONTROL} = V_{OFF}$ | $V_{CONTROL} = V_{ON}$ |
|---|---|---|
| P1 | OFF | ON; driving Vx to $V_{GATE}$ |
| N1 | ON; driving Vx to $V_{ON}$ | OFF |
| P2 | ON; | OFF |
| N2 | OFF | ON |
| N3 | ON, gate voltage is driven to $V_{GATE}$ | OFF |
| P3 | OFF | ON |
| $V_{OUT}$ | $V_{OUT}$ is driven to $V_{ON}$. When $V_{GATE}$ is more positive, settling to $V_{ON}$ is faster. | $V_{OUT}$ is driven to $V_{OFF}$ |

A method of and device for eliminating objectionable bands of uneven brightness on an FED screen has thus been disclosed. By measuring the output voltage of the row driver, the settling speed of the row driver is determined, and a signal representative of the settling speed is generated. The signal is then used to adjust the settling speed of the row driver by altering gate voltages of transistors in the output stages of the row drivers. As a result, the settling times of all the row drivers in the FED screen are matched. Consequently, the brightness variation problem is eliminated.

What is claimed is:

1. A field emission display (FED) including a plurality of rows and a plurality of columns, the FED comprising:

a plurality of column drivers each coupled to provide modulated signals to the columns;

a plurality of row drivers coupled to activate and deactivate the rows one row at a time, wherein each row driver has a settling time, further wherein the row drivers are activated one at a time; and a plurality of phase detection circuits each coupled to a respective one of the row drivers for comparing the settling time of each row driver with a pre-determined target settling time, the phase detection circuits for providing to the row drivers a phase signal representative of a time difference between the settling time and the target settling time, wherein each row driver adjusts the settling time to match the target settling time in response to the phase-signal.

2. The field emission display (FED) according to claim 1 wherein each row driver further comprises:

a first output stage for providing a first voltage to one of the rows; and a second output stage for providing a second voltage to a respective one of the phase detection circuits.

3. The field emission display (FED) according to claim 2 wherein the respective phase detection circuit compares the second voltage to a threshold voltage to generate an edge signal, and wherein the respective phase detection circuit generates a phase signal according to a phase difference between the edge signal and a reference signal.

4. The field emission display (FED) according to claim 3 wherein the reference signal occurs at the target setting time.

5. The field emission display (FED) according to claim 3 further comprising:

a low-pass filter coupled to the respective phase detector for averaging the phase signal; and a buffer coupled to the low-pass filter for providing the averaged phase signal to the row driver.

6. The field emission display (FED) according to claim 5 wherein each of the row drivers further comprises a gate-voltage input coupled to receive the averaged phase signal from the buffer, wherein the averaged phase signal controls a bias of output transistors within the first output stage, further wherein the settling time of the respective row driver is deviated towards the target settling time according to the averaged phase signal.

7. The field emission display (FED) according to claim 6 wherein the first output stage further comprises:

a p-channel transistor having:

a first source coupled to $V_{OFF}$, a first gate coupled to be controlled by the row driver logic circuit, a first drain; and an n-channel transistor having:

a second drain coupled to the first drain to form the row driver output voltage, a second source coupled to $V_{ON}$, a second gate biased by the averaged phase signal, wherein the output voltage is driven to the target voltage at a speed corresponding to the averaged phase signal.

8. A field Emission Display (FED) including a plurality of rows and a plurality of columns, the FED comprising:

a plurality of column drivers each coupled to provide modulated signals to a respective one of the columns;

a plurality of row drivers each having a row output for providing an output voltage, and a dummy output for providing a dummy output voltage;

a plurality of comparators each coupled to t a respective one of the row drivers, each comparator for comparing the dummy voltage of the respective row driver to a pre-determined threshold voltage, wherein an edge signal is generated as the dummy voltage crosses the threshold voltage;

a plurality of phase detectors each coupled to one of the comparators for generating a phase signal representative of a phase difference between the edge signal and a reference signal occurring at a target settling time; and a plurality of low-pass filters each coupled to a respective one of the phase detectors for averaging the phase signal to generate a gate-biasing voltage to row drivers, the gate-biasing voltage for deviating the settling time of the respective row driver towards the target settling time, wherein bands of uneven brightness of the FED display are eliminated when the settling times of the row drivers are normalized.

9. The field emission display (FED) according to claim 8 wherein the threshold voltage is a pre-determined fraction of the target voltage.

10. The field emission display (FED) according to claim 9 wherein the pre-determined fraction is 99%.

11. The field emission display (FED) according to claim 8 further comprising a dummy load, the dummy load having a resistance and a capacitance corresponding to one row of the FED display, wherein the row drivers are configured to drive the dummy load one driver at a time.

12. The field emission display (FED) according to claim 8 wherein the row output further comprises a plurality of output transistors, wherein the output transistors are biased by the gate-biasing voltage.

13. The field emission display (FED) according to claim 12 wherein the output transistors further comprises:

a first transistor;

a second transistor coupled to the first transistor for pulling the output voltage to $V_{ON}$, the second transistor having a gate biased by the gate-biasing voltage, wherein the settling time of the respective row driver is altered according to the gate-biasing voltage.

14. The field emission display (FED) according to claim 12 wherein the output transistors further comprises:

a first p-channel MOSFET having a first source connected to $V_{OFF}$, a first gate for receiving a control signal, and a first drain;

a second n-channel MOSFET having a second drain coupled to the first drain for forming the output voltage, a second source connected to $V_{ON}$, and a second gate;

a third p-channel MOSFET having a third drain connected to the second gate, a third gate, and a third source coupled to receive the gate biasing voltage;

a fourth n-channel MOSFET having a fourth source connected to $V_{ON}$, a fourth drain connected to the third drain and the second gate, and a fourth gate;

a fifth p-channel MOSFET having a fifth drain connected to the fourth gate, a fifth source coupled to receive the gate biasing voltage, and a fifth gate coupled to receive the control signal; and a sixth n-channel MOSFET having a sixth source connected to $V_{ON}$, a sixth drain connected to the fifth drain, and a sixth gate coupled to receive the control signal, wherein the control signal drives the output voltage to one of $V_{OFF}$ and $V_{ON}$, further wherein the output voltage is driven to $V_{ON}$ at a speed corresponding to the gate biasing voltage.

15. A row driver for driving a plurality of rows in a field emission display (FED), the row driver having an adjustable settling time, the row driver comprising:

a plurality of output stages, each of said plurality of output stages coupled to a respective pre-determined one of the rows for providing an output voltage;

a dummy output stage for producing a dummy voltage representative of the output voltage, said dummy output stage coupled to one of said plurality of output stages; and an input for receiving a gate-biasing voltage representative of a phase difference between the dummy voltage and a pre-determined threshold voltage, wherein the settling time is deviated towards the target settling time in response to the gate-biasing voltage.

16. The row driver of claim 15 further comprising a phase detection circuit for generating the phase difference.

17. The column driver of claim 16 wherein the phase detection circuit further comprises:

a comparator for comparing the dummy voltage to a threshold voltage, wherein a voltage transition signal is produced as the dummy voltage changes from a first voltage to a second voltage and crosses the threshold voltage; and a phase detector for generating a phase signal representative of a time difference between the voltage transition signal and a reference signal, wherein the reference signal occurs at the pre-determined target time.

18. The column driver of claim 17 wherein a first pulse having a positive polarity is produced when the voltage transition signal lags behind the reference signal, and wherein a pulse having a negative polarity is produced when the voltage transition leads the reference signal.

19. The row driver according to claim 15 wherein the output stage further comprises:

a p-channel MOSFET having a first source connected to $V_{OFF}$, a first gate for receiving a control signal, and a first drain; and an n-channel MOSFET having a second drain coupled to the first drain for forming the output voltage, a second source connected to $V_{ON}$, and a second gate coupled to receive the phase signal, wherein the n-channel MOSFET drives the output voltage to $V_{ON}$ according to the control signal, further wherein the settling time of the row driver is adjusted according to the gate-biasing voltage.

20. A method of eliminating bands of uneven brightness on a thin panel field emission display (FED), the FED having a plurality of rows and columns, the method comprising:

providing a plurality of row drivers for selectively activating a respective one of the rows;

generating a phase signal according to a difference between a settling time of the dummy output and a target settling time; and converting the phase signal into a gate-biasing voltage for deviating the settling time of each row driver towards the target settling time, wherein segments of uneven brightness are eliminated when the settling time of each row driver is normalized.

21. The method according to claim 20 wherein the step of generating further comprises the steps of:

providing a dummy output voltage for each of the row drivers;

comparing the dummy output voltage to a threshold voltage and generating an edge signal as the dummy output crosses the threshold voltage; and comparing the edge signal to a reference signal to produce the phase signal.

22. The method according to claim 21 wherein the reference signal occurs at the target settling time.

23. The method according to claim 20 wherein the step of converting further comprises the step of averaging the phase signal over a number of frame cycles.

* * * * *